United States Patent [19]

Komatsu et al.

[11] 4,009,086

[45] Feb. 22, 1977

[54] METHOD FOR A SURFACE TREATMENT OF AN IRON, FERROUS ALLOY OR CEMENTED CARBIDE ARTICLE

[75] Inventors: Noboru Komatsu, Toyoake; Tohru Arai; Yoshihiko Sugimoto, both of Nagoya, all of Japan

[73] Assignee: Kabushiki Kaisha Toyota Chuo Kenkyusho, Japan

[22] Filed: Oct. 17, 1975

[21] Appl. No.: 623,330

Related U.S. Application Data

[62] Division of Ser. No. 412,246, Nov. 2, 1973, Pat. No. 3,930,575.

[30] Foreign Application Priority Data

| | | |
|---|---|---|
| Nov. 6, 1972 | Japan | 47-111030 |
| Nov. 6, 1972 | Japan | 47-111033 |
| June 26, 1973 | Japan | 48-071276 |
| June 26, 1973 | Japan | 48-071277 |

[52] U.S. Cl. ..... 204/39

[51] Int. Cl.[2] ..... C25D 3/66

[58] Field of Search ..... 204/39, 60, 61

[56] References Cited

UNITED STATES PATENTS

| | | | |
|---|---|---|---|
| 2,820,745 | 1/1958 | von Bichowsky | 204/14 |
| 3,697,390 | 10/1972 | McCawley et al. | 204/39 |
| 3,827,954 | 8/1974 | McCawley et al. | 204/39 |

*Primary Examiner*—G. L. Kaplan

*Attorney, Agent, or Firm*—Wenderoth, Lind & Ponack

[57] ABSTRACT

A method for a surface treatment to form a hard layer including a IV-b group element of the Periodic Table on the surface of an iron, ferrous alloy or cemented carbide article in a molten bath, comprising preparing the molten bath composed of boron oxide and a IV-b group element, immersing the article in the molten bath and applying an electric current to, the molten bath through said article, said article being used as the cathode, thereby forming a very hard layer comprising the carbide of said IV-b group element on the surface of said article. The method of this invention can quickly form a uniform and dense hard layer on the surface of the article and can be carried out in the open air.

12 Claims, 11 Drawing Figures

(X 400)

(X 400)

(X 400)

(X 400)

(X 400)

(X 400)

(X 400)

(X 400)

(X 400)

(X 400)

METHOD FOR A SURFACE TREATMENT OF AN IRON, FERROUS ALLOY OR CEMENTED CARBIDE ARTICLE

This is a division of application Ser. No. 412,246, filed Nov. 2, 1973 now U.S. Pat. No. 3,930,575.

This invention relates to a method for forming a hard layer comprising the carbide of a IV-b group element of the periodic table or a complex layer composed of a carbide layer and a boride layer of said element on the surface of an iron, ferrous alloy or cemented carbide article, and more particularly it relates to the formation of said layer on the surface of the article immersed in a treating molten bath. The iron, ferrous alloy or cemented carbide article with said layers formed thereon has a greatly improved hardness, wear resistance and machinability.

The carbide and boride of a IV-b group element have been known to have a very high hardness ranging from Hv (Vicker's hardness scale) 2000 to Hv 3000 and to exhibit superior resistance to wear, corrosion and oxidation. Therefore it is very useful in the field of surface treatment to easily form in a simple process a layer of said carbide and/or boride on the surface of a structural part to be used at a high temperature or of a part to be subjected to severe wear.

Further, the carbide and boride of a IV-b group element are much harder and less reactive with iron or steel at a high temperature than the tungsten carbide forming cemented carbide is. The tungsten carbide tool coated with the carbide or boride layer of a IV-b group element is protected against crater wear. Therefore, the durability of the tool is greatly improved in addition to the improvement based on the hardness of the carbide layer and boride layer.

There have been reported several kinds of methods for coating or forming a hard layer such as a titanium carbide layer or titanium boride layer on the surface of metallic articles. However, the conventional methods have many difficulties in practical use. For example, the methods necessiate complex apparatus, non-oxidative atmosphere or complicated treating steps so that the productivity of these methods are insufficient.

Therefore, it is the principal object of the present invention to provide an improved method for forming a carbide and/or boride layer of a IV-b group element on the surface of an iron, ferrous alloy or cemented carbide article, which is safe and simple in practice and less expensive.

It is another object of this invention to provide a method for quickly forming a metallic carbide and/or carbide layer with denseness and uniformity on the surface of the article.

It is still another object of this invention to provide a method for forming a layer comprising a metallic carbide on the surface of the article treated in a molten bath.

It is a still further object of this invention to provide a method for forming a layer comprising a carbide on the surface of the article by applying an electric current to the article.

Other objects of this invention will appear hereinafter.

The novel features that are considered characteristic of the invention are set forth with particularity in the appended claims. The invention, itself, as to its method of operation, together with additional objects and advantages therefore, will best be understood from the following description of specific embodiments when read in connection with the accompanying drawings, in which:

Figure 1:
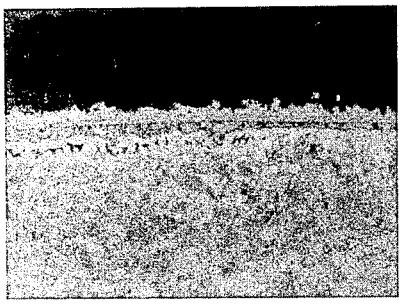
FIG. 1 is a photomicrograph showing the layer formed on carbon tool steel according to Example 1.

Broadly, the present invention is directed to an improvement of the method for forming a very hard layer on an iron, ferrous alloy or cemented carbide article in a molten treating bath and is characterized in that the treating bath is composed of a boron oxide and a IV-b group element of the Periodic Table dissolved therein and in that an electric current is applied to an article immersed in the molten treating bath to deposit the IV-b group element on the surface of the article. The element deposited reacts with the carbon contained within the article and forms the carbide layer of the IV-b group element on the surface of the article. Namely, the method of the present invention comprises preparing a molten bath containing a molten boron oxide and a IV-b group element, immersing an iron, ferrous alloy or cemented carbide article in the molten bath, applying an electric current to the molten bath through the article being used as the cathode, to form the carbide layer of the IV-b group element on the surface of the article.

The electric current activates the deposition of the IV-b group element dissolved in the treating molten bath on the surface of the article and accelerates the formation of the carbide layer of the IV-b group element on the surface of the article. The voltage of the electric current is relatively low. It is not necessary for said voltage to be high enough for electrolysis of the molten boron oxide in the treating molten bath. In order to accelerate the formation of the carbide layer of a IV-b group element on the surface of the article, a relatively high voltage (in other words, a relatively large current density at the cathode) may be employed. In that case, large current density deposits the reduced boron on the surface of the article together with a IV-b group element. Therefore, the carbide layer of the IV-b group element include a small amount of a boride of a IV-b group element such as titanium boride ($TiB_2$), zirconium boride ($ZrB_2$) and hafnium boride ($HfB_2$), and in some cases, the boride layer of a IV-b group element is formed on the carbide layer of a IV-b group element. Said boride of a IV-b group element has been known to have a much higher hardness than that of the carbide of a IV-b group element. Also said boride has good wear resistance and corrosion resistance against chemical reagent and molten metal. Therefore, the boride layer of a IV-b group element formed and the carbide layer containing the boride work as well as the carbide layer of a IV-b group element. However, with too large a current density, the deposition of boron is excessive and prevents the IV-b group element from depositing on the surface of the article. Also said deposited boron forms boride such as iron boride and cobalt boride with metals of the mother material of the article. Therefore, too large a current density at the anode is undesirable.

The effective current density of the cathode, which is the article to be treated, depends on the substance including a IV-b group element in the molten treating bath and on the material forming the article to be treated.

The molten bath used in the present invention is composed of a molten boron oxide and a substance containing a IV-b group element.

As the said boron oxide, boric acid ($B_2O_3$), borate such as sodium borate (borax) ($Na_2B_4O_7$), potassium borate ($K_2B_4O_7$), lithium borate ($Li_2B_4O_7$) and the like and mixtures thereof can be used. The boric acid and borate have the function of dissolving the metallic oxide and keeping the surface of the article to be treated clean, and also the boric acid and borate are not poisonous and hardly vaporize. Therefore, the method of the present invention can be carried out in the open air.

As the said group IV-b substance, the metals of a IV-b group element, alloys containing a IV-a group element, the oxide and halide of a IV-b group element such as $TiO_2$, $K_2TiO_3$, $Na_2TiO_3$, $Li_2TiO_3$, $ZrO_2$, $ZrOCl_2$, $TiCl_3$, $TiF_6$, $Na_2TiF_6$, $Na_2ZrF_6$, $HfF_4$, $HfCl_4$, $(NH_4)_2TiF_6$, $TiI_4$ can be used. In order to prepare the molten bath, the powder of said substance is introduced in the molten boron oxide, or the powder of said substance and the powder of said boron oxide are mixed together and then the mixture is heated up to its fused state. By another method, a block of said metals or alloys immersed in the bath is anodically dissolved in the molten boron oxide for preparing the molten treating bath.

When the metal of a IV-b group element or the alloy containing the IV-b group element is used as the source of a IV-b group element and is dissolved in the molten bath, the powders or thin plates of said metal or alloy may be added to molten boron oxide and kept therein for a time sufficient to dissolve said powder or plates into said molten boron oxide. The speed of the dissolution of said metal or alloy into the molten boron oxide is relatively slow so that the powders or plates of said metal or alloy should be fine. Preferably the powder is of under 20 mesh. Preparing the molten bath by said method is easily done, however, undissolved powders remain in the bath, and happen to be attached to the surface of an article being treated and roughen the surface of the article.

As the quantity of the metal or alloys of a IV-b group element dissolved in the molten bath, 1% by weight of said metal or alloy may be sufficient (hereinafter % means % by weight). In practice, however, the metal or alloy may be dissolved into the treating molten bath in a quantity between 1 and 40%. With use of a lower quantity of the metal or alloy than 1%, the speed of formation of the surface layer would be too slow to be acceptable for practical purpose. Too great an addition of the metal or alloy than 40% will increase the viscosity of the molten bath that the resultant surface layer will become too uneven to be acceptable.

As the source of a IV-b group element dissolved in the molten bath, the powders of said oxides or halides may be introduced in a molten boron oxide, or said powders may be mixed with the powders of the boron oxide and heated to their molten state. The powders of the oxides and halides of a IV-b group element are dissolved easily into the molten boron oxide without leaving undissolved powders. The quantity of the oxides or halides of a IV-b group element dissolved in the treating molten bath is in a range of from 1 to 40%. More preferably, the quantity may be selected between 5 and 25%.

The molten bath is also prepared by dipping the block of said metal or alloy in molten boron oxide and applying an electric current to said molten boron oxide, said block being used as the anode for anodically dissolving said block in said molten boron oxide. The current applied for dissolving the block is to accelerate the dissolution of the block. Although the speed of the dissolution increases according to increase of the current density of the anode, the current density does not necessarily have to be large. In practice, the current density is within a range from 0.1 to 10 A/cm$^2$. By said method, a molten bath without undissolved powders can be obtained.

An iron, ferrous alloy or cemented carbide article is immersed in the molten bath prepared by said means, and an electric current is applied to the molten bath through the article being used as the cathode, to form the surface layer including the IV-b group element on the surface of the article.

With use of the molten bath composed of molten boron oxide and the metal or alloy of a IV-b group element dissolved therein, the article made of iron or ferrous alloy is treated at a current density at the cathode (article to be treated) of between 0.005 and 1.5 A/cm$^2$, more preferably between 0.01 and 0.3 A/cm$^2$, and the article made of cemented carbide is treated at a current density at the cathode of between 0.01 and 15 A/cm$^2$.

With use of the molten bath composed of molten boron oxide and the oxide of a IV-b group element, the article made of iron or ferrous alloy is treated at a current density at the cathode of between 0.01 and 3 A/cm$^2$, more preferably between 0.02 and 0.5 A/cm$^2$, and the article made of cemented carbide is treated at a current density at the cathode of between 0.01 and 15 A/cm$^2$.

With use of the molten bath composed of molten boron oxide and the halide of a IV-b group element, the article made of iron or ferrous alloy is treated at a current density at the cathode of between 0.01 and 5 A/cm$^2$, more preferably between 0.1 and 1 A/cm$^2$, and the article made of cemented carbide is treated at a current density at the cathode of between 0.01 and 15 A/cm$^2$.

The surface layer formed has a tendency to be a carbide layer of a IV-b group element or to be a carbide layer having a thin boride layer of said element thereon when the current density of the cathode is relatively low within said range of the current density of the cathode. With an increase of the current density of the cathode, the thickness of the boride layer of a IV-b group element on the carbide layer of said element increases, and boride of the material of the article to be treated such as FeB, $Fe_2B$, $W_2B_5$ or $Co_3B$ is formed when the current density of the cathode is over said upper limits of said range.

The iron, ferrous alloy or cemented carbide to be treated must contain at least 0.05% carbon, preferably 0.1% carbon or higher. The carbon in the article becomes the carbide during the treatment. Namely it is assumed that the carbon in the article diffuses to the surface thereof and reacts with the metal from the treating molten bath to form the carbide on the surface of the article. Higher content of the carbon in the article is preferable for forming the carbide layer. Iron, ferrous alloy or cemented carbide article containing less than 0.05% of carbon may not be formed with a uniform and thick carbide layer by the treatment. Also, article containing at least 0.05% of carbon only in the surface portion thereof can be treated to form a carbide layer on the surface of the article. For example, a pure iron article, which is case-hardened to increase the carbon content in the surface portion thereof, can be used as the article of the present invention.

Here, iron means iron containing carbon and case-hardened iron, ferrous alloy means carbon steel and alloy steel, and cemented carbide means a sintered tungsten carbide containing cobalt. Said cemented carbide may include a small amount of titanium carbide, niobium carbide, tantalum carbide and the like. Also, the article to be treated include the cast products formed, products by hot or cold working and sintered products.

In some cases, the carbon contained in the molten bath can be used as the source of the carbon for forming the carbide layer on the surface of the article. However, the formation of the carbide layer is not stable and the use of the carbon in the molten bath is not practical.

Before the treatment, it is important to purify the surface of the article to form a good carbide and/or carbide layer by removing rust and oil from the surface of the article with acidic aqueous solution or another suitable liquid.

The treatment temperature may be selected within the wide range from the melting point of boric acid or borate to the melting point of the article to be treated. Preferably, the treatment temperature may be selected within the range of 800° to 1100° C. With lowering of the treatment temperature, the viscosity of the molten bath increases gradually and the thickness of the carbide layer formed decreases. However, at a relatively high treatment temperature, the molten bath deteriorates rapidly. Also the quality of the material forming the article deteriorates from an increase of the crystal grain size thereof.

The treatment time depends upon the thickness of the surface layer to be formed, treatment temperature and the current density of the anode. Heating shorter than 2 minutes will, however, provide no practically acceptable formation of said layer. With the increase of the treatment time, the thickness of the surface layer will be increased correspondingly. In practice, an acceptable thickness of the layer can be realized within 5 hours or less time. The preferred range of the treating time will be from 2 minutes to 5 hours.

The vessel for keeping the molten bath of the present invention can be made of graphite or heat resistant steel.

It is not necessary to carry out the method of the present invention in an atmosphere of non-oxidative gas, but the method can be carried out into effect either under an air or inert gas atmosphere.

EXAMPLE 1

1000 grams of borax was introduced into a graphite crucible having a 65 mm inner diameter and heated to 900° C in an air atmosphere in an electric furnace to melt the borax. Then, 100 rams of thin titanium plates (10 × 10 × 0.5 cm) were placed in the crucible and kept, with mixing for 5 hours to dissolve the thin plate in the molten borax. Thus, the molten bath was prepared. Next, each of Specimens 1-1 to 1-9 having a 7mm diameter and made of carbon tool steel (JIS SK4 : containing 0.8% carbon) was immersed in the molten bath and treated under the respective condition shown in Table 1 by using the specimen as a cathode and the crucible as an anode.

Table 1

| Specimen No. | 1-1 | 1-2 | 1-3 | 1-4 | 1-5 | 1-6 | 1-7 | 1-8 | 1-9 |
|---|---|---|---|---|---|---|---|---|---|
| Current Density of Cathode(A/cm²) | 0.01 | 0.03 | 0.05 | 0.1 | 0.5 | 1 | 2 | 3 | 5 |
| Treating Time (hr.) | 2 | 2 | 2 | 2 | 2 | 7/60 | 7/60 | 5/60 | 5/60 |
| Thickness of the formed layer or layers ($\mu$) | 7 | 10 | 20 | 18 | 22 | 5 | 20 | 23 | 40 |

After the treatment, each of the Specimens was taken out of the molten bath, cooled in the air, and washed with hot water to remove the treating material adhered onto the Specimen. All Specimens were cut vertically and the cross sections were polished and microscopically observed. Also, Specimens were examined by X-ray micro analyzer and by an X-ray diffraction method.

All of the treated Specimens had a layer or layers having the respective thickness shown in Table 1 formed thereon. The layers formed on each of Specimens 1-1 to 1-6 were observed to consist of three layers. The three layers were identified to be a titanium boride ($TiB_2$) layer forming its upper most layer, a titanium carbide (TiC) layer forming its middle layer and an iron boride ($Fe_2B$) layer forming its lowest layer. As an example of the layers, a photomicrograph taken from Specimens 1-6 is shown in FIG. 1. The layers formed on each of Specimens 1-7 to 1-9 were identified to be compsed of mostly iron boride (FeB and $Fe_2B$). Titanium carbide was not detected in the layers.

EXAMPLE 2

1000 grams of borax was introduced into a graphite crucible having a 65mm inner diameter and heated to 900° C for melting the borax in an electric furnace under the air. Then, 430 grams of ferro-titanium powder of less than 100 mesh was introduced in the molten borax bath and mixed togther. The bath was kept for 1 hour to dissolve the powder into the molten borax. Thus, the molten bath was prepared. Next, each of Specimens 2-1 to 2-3 having a 7mm diameter and made of carbon tool steel was treated in the molten bath under the respective condition shown in Table 2 in the same manner as described in Example 1. After the treatment, Specimens 2-1 to 2-3 were examined in the same way described in Example 1. All the treated Specimens with a layer or layers having the respective thickness shown in Table 2 were formed.

Table 2

| Specimen No. | 2-1 | 2-2 | 2-3 |
|---|---|---|---|
| Current Density of Cathode (A/cm²) | 0.1 | 0.25 | 1.0 |
| Treating Time (hr.) | 4 | 8 | 4 |
| Thickness of the formed layer or layers (μ) | 10 | 20 | 30 |

Figure 2:
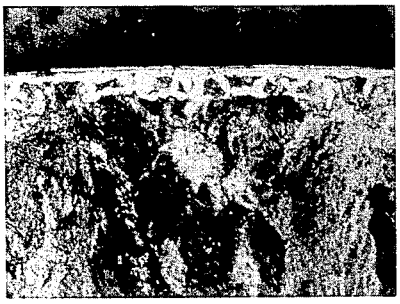
FIG. 2 is a photomicrograph showing the layer formed on carbon tool steel according to Example 2.

The layer formed on Sample 2-1 was identified as a titanium carbide (TiC) layer. The layers formed on Sample 2-2 were identified as composed of two layers, a titanium carbide (TiC) layer forming the upper layer and an iron boride ($Fe_2B$) layer forming the lower layer. The layers formed on Specimen 2-3 were identified as composed of three layers, a titanium boride ($TiB_2$) layer forming the upper most layer, a titanium carbide (TiC) layer forming the middle layer, and an iron boride ($Fe_2B$) layer forming the lowest layer. The layers formed on Specimen 2-3 are shown in the photomicrograph of FIG. 2.

EXAMPLE 3

1000 grams of borax was introduced into a graphite crucible having a 65mm inner diameter and heated to 900° C in an electric furnace under an argon gas atmosphere to melt the borax. Then, a metallic titanium rod having a diameter of 10mm and a length of 50mm was immersed into the molten borax and anodically dissolved in the molten borax for 2 hours at an anodic current density of 6 A/cm² by using the rod as anode and the crucible as cathode. By this anodic dissolution, a molten bath containing 8.3% of titanium was prepared.

Next, each of Specimens 3-1 to 3-3 having a 7mm diameter and made of carbon tool steel was treated in the treating molten bath under the respective condition shown in Table 3 in the same manner as described in Example 1.

Table 3

| Specimen No. | 3-1 | 3-2 | 3-3 |
|---|---|---|---|
| Current Density of Cathode (A/cm²) | 0.05 | 0.1 | 1.0 |

Table 3-continued

| Specimen No. | 3-1 | 3-2 | 3-3 |
|---|---|---|---|
| Treating Time (hr.) | 2 | 2 | 10/60 |
| Thickness of the formed layer or layers (μ) | 11 | 9 | 2 |

After the treatment, Specimens 3-1 to 3-3 were examined in the same way described in Example 1. All the treated Specimens had a layer or layers having the respective thickness shown in Table 3 formed thereon. The layers formed on each of Specimens 3-1 to 3-3 were identified as consisting of the upper most layer composed of titanium boride ($TiB_2$), the middle layer composed of titanium carbide (TiC) and the lowest layer compsed of iron boride ($Fe_2B$).

EXAMPLE 4

500 grams of borax was introduced into a graphite crucible having a 65mm inner diameter and heated up to 900° C in an electric furnace under air to melt the borax. Then, 125 grams of titanium oxide ($TiO_2$) powder was introduced in the molten borax and mixed together. Thus, the molten bath was prepared.

Next, each of Specimens 4-1 to 4-11 having a 7mm diameter and made of carbon tool steel was treated in the molten bath under the respective conditions shown in Table 4 in the same manner as described in Example 1. After the treatment, Specimens 4-1 to 4-11 were examined in the same way described in Example 1. All of the treated Specimens had a layer or layers having the respective thickness shown in Table 4 formed thereon. The construction and composition of each of the formed layers are also listed in Table 4.

Figure 4:
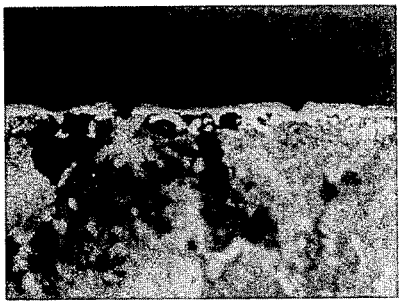
FIGS. 3 and 4 are photomicrographs showing the layer formed on carbon tool steel according to Example 4.
Figure 3:
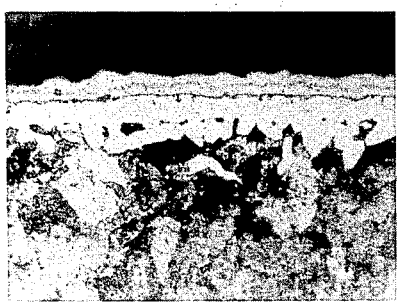

As examples of the formed layers, each of the layers formed on Specimens 4-3 and 4-6 are respectively shown in the photomicrographs of FIGS. 3 and 4.

Table 4

| Specimen No. | | 4-1 | 4-2 | 4-3 | 4-4 | 4-5 | 4-6 | 4-7 | 4-8 | 4-9 | 4-10 | 4-11 |
|---|---|---|---|---|---|---|---|---|---|---|---|---|
| Treating Condition | Current Density (A/cm²) | 0.01 | 0.03 | 0.07 | 0.10 | 0.20 | 0.30 | 0.50 | 1.00 | 3.00 | 4.00 | 5.00 |
| | Treating Time (hr.) | 14 | 14 | 14 | 14 | 4 | 4 | 4 | 4 | 4 | 4 | 5/60 |
| | Thickness (μ) | 12 | 15 | 30 | 45 | 7 | 10 | 13 | 20 | 20 | 60 | 22 |
| Formed Layer | Upper most Layer | $TiB_2$ | $TiB_2$ | $TiB_2$ | $TiB_2$ | $TiB_2$ | $TiB_2$ | $TiB_2$ | $TiB_2$ | $TiB_2$ | $Fe_2B$ | $Fe_2B$ |
| | Middle Layer | TiC | TiC | TiC | TiC | TiC | TiC | TiC | TiC | TiC | — | — |
| | Lowest Layer | $Fe_2B$ | $Fe_2B$ | $Fe_2B$ | $Fe_2B$ | $Fe_2B$ | $Fe_2B$ | $Fe_2B$ | $Fe_2B$ | $Fe_2B$ | — | — |

The layers formed on specimens 4-8 and 4-9 were composed mainly of their lowest, iron boride layers, and their upper most layers composed of titanium boride and middle layers composed of titanium carbide were very thin. The layers formed on Specimens 4-10 and 4-11 are iron boride which is not desired as the uppermost layer in the present invention.

EXAMPLE 5

500 grams of borax was introduced into a graphite crucible having a 65mm inner diameter and heated up to 900° C in an electric furnace under air to melt the borax. Then, 56 grams of titanium oxide ($TiO_2$) powder was introduced in the molten borax and mixed together. Thus, the molten bath was prepared.

Next, each of Specimens 5-1 to 5-3 having a 7mm diameter and made of carbon tool steel was treated in the molten bath under the respective conditions shown in Table 5 in the same manner as described in Example 1. After the treatment, Specimens 5-1 to 5-3 were examined in the same way as described in Example 1. All of the treated Specimens were formed with a layer or layers having the respective thickness shown in Table 5. The construction and composition of each of the formed layers are also listed in Table 5.

Table 5

| Specimen No. | | 5-1 | 5-2 | 5-3 |
|---|---|---|---|---|
| Treating Condition | Current Density ($A/cm^2$) | 0.1 | 0.25 | 1 |
| | Treating Time (hr.) | 4 | 8 | 4 |
| | Thickness ($\mu$) | 8 | 11 | 32 |
| Forme Layer | Upper most Layer | TiC | TiC | $TiB_2$ |
| | Middle Layer | — | $Fe_2B$ | TiC |
| | Lowest Layer | — | — | $Fe_2B$ |

Figure 5:
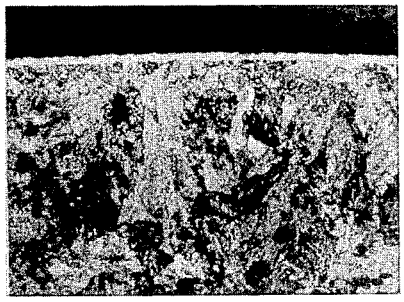
FIGS. 5 and 6 are photomicrograph showing the layers formed on carbon tool steel according to Example 5.
Figure 6:
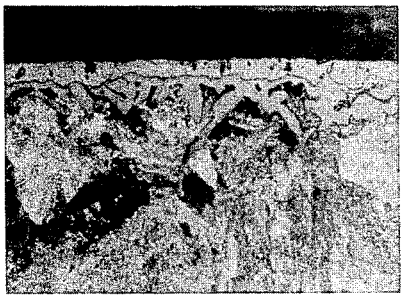

The microphotographs shown in FIGS. 5 and 6 show respectively the layers formed on Specimens 5-1 and 5-2.

As known from the results of Examples 1 and 2, a layer composed of titanium carbide or layers composed of titanium carbide and titanium boride may be formed on a specimen by the treatment using the molten bath containing a relatively small amount of titanium oxide and a relatively low current density at the cathode.

EXAMPLE 6

80 grams of borax was introduced into a graphite crucible having a 35mm inner diameter and heated up to 1000° C in an electric furnace under air to melt the borax. Then 25 grams of potassium titanate ($K_2TiO_3$) block was introduced into the molten borax and mixed together. Thus, the molten bath was prepared.

Next, each of Specimens 6-1 to 6-7 having a 7mm diameter and made of carbon tool steel was treated in the molten bath under the respective conditions shown in Table 6 in the same manner as described in Example 1. After the treatment, Specimens 6-1 to 6-7 were examined in the same way as described in Example 1. All of the treated Specimens were formed with a layer or layers having the respective thickness shown in Table 6. The construction and composition of each of the formed layers are also listed in Table 6.

Table 6

| Specimen No. | | 6-1 | 6-2 | 6-3 | 6-4 | 6-5 | 6-6 | 6-7 |
|---|---|---|---|---|---|---|---|---|
| Treating Condition | Current Density ($A/cm^2$) | 0.01 | 0.05 | 0.1 | 0.5 | 1.0 | 3.0 | 5.0 |
| | Treating Time(hr.) | 2 | 2 | 2 | 2 | 10/60 | 5/60 | 3/60 |
| | Thickness ($\mu$) | 18 | 20 | 26 | 33 | 6 | 8 | 20 |
| Formed Layer | Upper most Layer | $TiB_2$ | $TiB_2$ | $TiB_2$ | $TiB_2$ | TiC | TiC | $Fe_2B$ |
| | Middle Layer | TiC | TiC | TiC | TiC | $Fe_2B$ | $Fe_2B$ | — |
| | Lowest Layer | $Fe_2B$ | $Fe_2B$ | $Fe_2B$ | $Fe_2B$ | — | — | — |

The layer formed on Specimen 6-7 is an iron boride ($Fe_2B$) layer which is not desired as the uppermost layer in the present invention.

Figure 7:
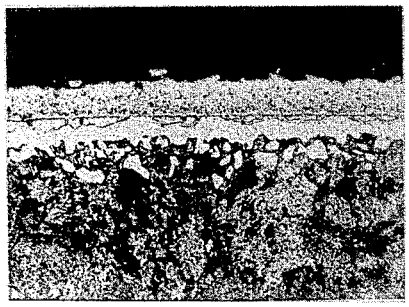
FIG. 7 is a photomicrograph showing the layer formed on carbon tool steel according to Example 6.

The photomicrograph shown in FIG. 7 shows the layer formed on Specmen 6-4.

EXAMPLE 7

500 grams of borax was introduced into a graphite crucible having a 65mm inner diameter and heated to 1000° C in an electric furnace under air to melt the borax. Then 240 grams of $Na_2TiF_6$ powder was introduced into the molten borax and mixed together. Thus, the molten bath was prepared.

Next, each of Specimens 7-1 to 7-6 having a 7mm diameter and a 40mm length and made of carbon tool steel was treated in the molten bath under the respective conditions shown in Table 7 in the same manner as described in Example 1. After the treatment, Specimens 7-1 to 7-6 were examined in the same way as described in Example 1. All the treated Specimens had a layer or layers having the respective thickness shown in Table 7 formed thereon. The construction and composition of each of the formed layers are also listed in Table 7.

The layers formed on each of Specimens 7-1 to 7-3 were identified as composed of two layers, a titanium carbide layer and an iron boride layer. Each of the titanium carbide layers was about 3 microns. The layers formed on Specimen 7-4 were identified as consisting of the uppermost layer composed of titanium boride and having a 14 micron thickness, the middle layers composed of titanium carbide and having a 3 micron thickness, and the lowest layer composed of iron boride layer. The layers formed on Specimen 7-5 were identified as consisting of the uppermost layer composed of titanium boride and having a 14 micron thickness, the middle layer composed of titanium carbide and having a 5 micron thickness, and the lowest layer composed of iron boride. The layers formed on Specimen 7-6 were identified as consisting of the thin uppermost and middle layers composed respectively of titanium boride and titanium carbide and the relatively thick lowest layer composed of iron boride. The total thickness of the uppermost and middle layer was about several microns.

Table 7

| Specimen No. | | 7-1 | 7-2 | 7-3 | 7-4 | 7-5 | 7-6 |
|---|---|---|---|---|---|---|---|
| Treating Condition | Current Density ($A/cm^2$) | 0.01 | 0.05 | 0.1 | 0.5 | 1.0 | 5 |
| | Treating Time (hr.) | 2 | 2 | 2 | 2 | 10/60 | 5/60 |

Table 7-continued

| Specimen No. | | 7-1 | 7-2 | 7-3 | 7-4 | 7-5 | 7-6 |
|---|---|---|---|---|---|---|---|
| | Thickness ($\mu$) | 10 | 12 | 21 | >17 | >19 | > several microns |
| Formed Layer | Upper most Layer | TiC | TiC | TiC | $TiB_2$ | $TiB_2$ | $TiB_2$ |
| | Middle Layer | $Fe_2B$ | $Fe_2B$ | $Fe_2B$ | TiC | TiC | TiC |
| | Lowest Layer | — | — | — | $Fe_2B$ | $Fe_2B$ | $Fe_2B$ |

Figure 8:
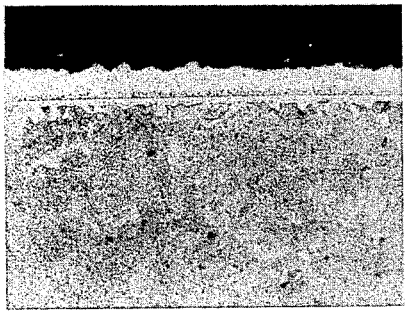
FIG. 8 is a photomicrograph showing the layer formed on carbon tool steel according to Example 7.
Figure 10:
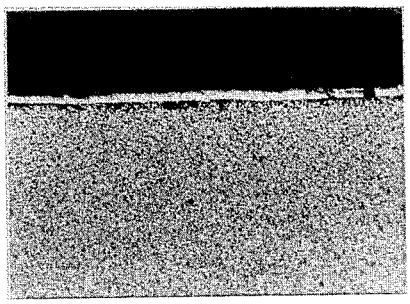
FIG. 10 is a photomicrograh showing the layers formed on cemented carbide according to Example 11.

The photomicrograph shown in FIG. 8 shows the layers formed on Specimen 7-5.

EXAMPLE 8

The molten bath made of 500 grams of borax and 230 grams of $(NH_4)_2TiF_6$ powder was prepared in the same manner as described in Example 7. Next, each of Specimens 8-1 to 8-7 having a 7mm diameter and a 40mm length and made of carbon tool steel was treated in the molten bath maintained at 1000° C under the respective condition shown in Table 8 in the same manner as described in Example 1.

Table 8

| Specimen No. | | 8-1 | 8-2 | 8-3 | 8-4 | 8-5 | 8-6 | 8-7 |
|---|---|---|---|---|---|---|---|---|
| Treating Condition | Current Density ($A/cm^2$) | 0.01 | 0.05 | 0.1 | 0.5 | 1 | 3 | 5 |
| | Treating Time (hr.) | 2 | 2 | 2 | 2 | 10/60 | 10/60 | 3/60 |

After the treatment, Specimens 8-1 to 8-7 were examined in the same way as described in Example 1. All the treated Specimens 8-1 to 8-7 were formed respectively with the layers consisting of the uppermost layer composed of titanium boride ($Ti_2B$), the middle layer composed of titanium carbide (TiC) and the lowest layer composed of iron boride ($Fe_2B$). The respective total thickness of each of the layers formed of each of Specimens 8-1 to 8-4 was 23, 25, 42 and 51 microns. The thickness of the uppermost layer formed on Specimens 8-1 to 8-4 was 13, 10, 8 and 7 microns respectively and the thickness of the middle layer was 5, 5, 3 and 3 microns respectively. The uppermost and middle layers have a tendency to decrease with increase of the current density of the cathode in the treatment. The layers formed on each Specimen 8-5 to 8-6 were identified as consisting of a relatively thin uppermost and middle layers having a thickness of a several microns and the relatively thick lowest layers.

EXAMPLE 9

In the same manner as described in Example 7, the molten bath composed of 70 grams of borax and 43 grams of titanium iodide ($TiI_4$) was prepared in a graphite crucible having a 35mm inner diameter and maintained at 1000° C.

Next, Specimens 9-1 and 9-2 having a 7mm diameter and a 40mm length and made of carbon tool steel were treated respectively with a current density of 0.03 $A/cm^2$ for 3 hours and with a current density of 0.3 $A/cm^2$ for 3 hours in the same manner, as described in Example 1. After the treatment, Specimens 9-1 and 9-2 were examined in the same manner as described in Example 1. Sample 9-1 was formed with layers consisting of the uppermost and middle layers composed respectively of titanium boride ($Ti_2B$) and titanium carbide (TiC) and having a 5 micron thickness and the lowest layer composed or iron boride ($Fe_2B$). The total thickness of the layers was 32 microns. Sample 9-2 was formed with layers consisting of the uppermost and middle layers composed respectively of titanium boride ($Ti_2B$) and titanium carbide (TiC) and having an 8 micron thickness and the lowest layer composed of iron boride ($Fe_2B$). The total thickness of the layers was 45 microns.

EXAMPLE 10

In the same manner as described in Example 7, the molten bath composed of 70 grams of borax and 25 grams of titanium chloride ($TiCl_3$) was prepared and maintained at 1000° C.

Next, Specimens 10-1 to 10-3 having a 7 mm diameter and a 40mm length and made of carbon tool steel were treated respectively with a current of 0.3 $A/cm^2$ for 3 hours, with a current density of 0.3 $A/cm^2$ for 3 hours and with a current density of 3 $A/cm^2$ for 5 minutes in the same manner as described in Example 1. After the treatment, Specimens 10-1 to 10-3 were examined in the same manner as described in Example 1. Each Specimens 10-1 to 10-3 were formed with layers consisting of the uppermost layer composed of titanium boride ($Ti_2B$), the middle layer composed of titanium carbide (TiC) and the lowest layer composed of iron boride ($Fe_2B$). The total thickness of layers formed on Specimens 10-1 to 10-3 was 28, 35 and 55 microns respectively, and the combined thickness of the both layers titanium boride layer and titanium carbide layers formejd on Specimens 10-1 to 10-3 was 10, 13 and 4 microns respectively.

Figure 9:
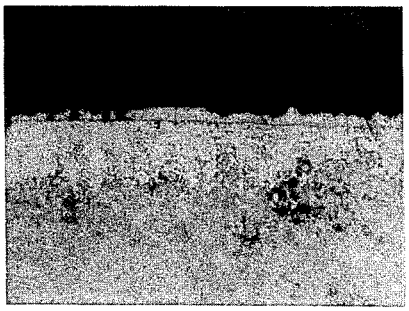
FIG. 9 is a photomicrograph showing the layer formed on carbon tool steel according to Example 10.

The photomicrograph of FIG. 9 shows the layers formed on Specimen 10-1.

EXAMPLE 11

500 grams of borax was introduced into a graphite crucible having a 65mm inner diameter and heated up to 1000° C in an electric furnace under air to melt the borax. Then, the into the crucible was introduced 56 grams of tiny titanium plates having a 0.5mm thickness and kept for a time sufficient to dissolve the titanium plates into the molten borax. Thus, the molten bath was prepared.

Next, each of Specimens 11–1 to 11–7 having a size of 40 × 5.5 × 1.0mm and made of cemented carbide composed of 91% of tungsten carbide and 9% of cobalt were treated under the respective conditions shown in Table 9 in the same manner as described in Example 1. After the treatment, Specimens 11–1 to 11–7 were examined in the same way as described in Example 1. All the treated Specimens 11–1 to 11–7 were formed respectively with the dense layers having a respective thickness shown in Table 9.

Each of the layers formed on Specimens 11–1 to 11–6 was identified as consisting of two layers, the upper layer composed of titanium boride ($TiB_2$) and the lower layer composed of titanium carbide (TiC). The layers formed on Specimen 11–7 was identified as consisting of two layers, the upper layer composed of titanium boride ($TiB_2$) and the lower layer composed of cobalt boride ($Co_3B$).

Table 9

| Specimen No. | 11–1 | 11–2 | 11–3 | 11–4 | 11–5 | 11–6 | 11–7 |
|---|---|---|---|---|---|---|---|
| Current Density of Cathode (A/cm²) | 0.01 | 0.05 | 0.1 | 0.5 | 1.0 | 5.0 | 10 |
| Treating Time (hr.) | 15 | 15 | 5 | 8 | 1 | 1 | 10/60 |
| Thickness of the formed layer or Layers (μ) | 10 | 12 | 5 | 12 | 10 | 6 | 15 |

In order to test the oxidation resistance and corrosion resistance of the specimens treated according to this Example, many specimens, treated under the same conditions as that of Specimen 11–3, and non-treated specimens were subjected to either an oxidation test or a corrosion test. The oxidation test involved heating a specimen in the open air at 800° C for 1 hour and then measuring the weight gain of the specimen due to the oxidation of the specimen. The corrosion test involved dipping a specimen into an aqueous solution containing 10% of nitric acid ($HNO_3$) for 5 hours at 20° C and then measuring the weight loss of the specimen due to the dissolution of the specimen. The oxidation gain of the specimen treated under the same condition as that of Specimen 11–3 was 8.96 mg/cm². In comparison, the oxidation gain of the non-treated specimen was 61.87 mg/cm². The dissolved weight loss of the specimen treated under the same condition as that of Specimen 11–3 was 5.39 mg/cm². In comparison, the dissolved weight loss of the non treated specimen was 23.07 mg/cm².

It is apparent from the results that the cemented carbide articles with the layers formed according to this Example have a great oxidation and corrosion resistance.

EXAMPLE 12

500 grams of borax was introduced into a graphite crucible having a 65mm inner diameter and heated to 1000° C in an electric furnace under air to melt the borax. Then a metallic titanium rod having a 10mm diameter was immersed into the molten borax and anodically dissolved in the molten borax for 2 hours at an anodic current density of 1 A/cm² by using the rod as anode and the crucible as cathode. By this anodic dissolution, a molten bath containing about 8.3% of titanium was prepared.

Next, each of Specimens 12–1 to 12–5 having a size of 40 × 5.5 × 1.0mm and made of cemented carbide composed of 91% of tungsten carbide and 9% of cobalt was treated under the respective condition shown in Table 10 in the same manner as described in Example 1. After the treatment, Specimens 12–1 to 12–5 were examined in the same way as described in Example 1. All the treated Specimens 12–1 to 12–5 were formed respectively with the layers having a respective thickness shown in Table 10. Each of the layers formed on Specimens 12–1 to 12–3 was identified as consisting of two layers, the upper layer composed of titanium boride ($TiB_2$) and the lower layer composed of titanium carbide (TiC). The layers formed on each Specimens 12–4 and 12–5 were found to consist of three layers, the uppermost layer composed of titanium boride, the middle layer composed of titanium carbide and the lowest layer composed of cobalt boride ($Co_3B$).

Table 10

| Specimen No. | 12–1 | 12–2 | 12–3 | 12–4 | 12–5 |
|---|---|---|---|---|---|
| Current Density of Cathode (A/cm²) | 0.05 | 0.5 | 1.0 | 5.0 | 10 |
| Treating Time (hr.) | 15 | 10 | 5 | 1 | 10/60 |
| Thickness of the formed Layer or Layers (μ) | 10 | 10 | 6 | 15 | 5 |

EXAMPLE 13

500 grams of borax was introduced into a graphite crucible having a 65mm inner diameter and heated up to 1000° C in an electric furnace under air to melt the borax. Then, 240 grams of $Na_2TiF_6$ powder was introduced into the molten borax and mixed together. Thus, the molten bath was prepared.

Next, each of Specimens 13–1 to 13–9 having a size of 40 × 5.5 × 1.0mm and made of cemented carbide composed of 91% of tungsten carbide and 9% of cobalt was treated under the respective conditions shown in Table 11 in the same manner as described in Example 1.

Table 11

| Specimen No. | 13–1 | 13–2 | 13–3 | 13–4 | 13–5 | 13–6 | 13–7 | 13–8 | 13–9 |
|---|---|---|---|---|---|---|---|---|---|
| Current Density of Cathode (A/cm²) | 0.01 | 0.05 | 0.1 | 0.5 | 1.0 | 5.0 | 10 | 15 | 20 |
| Treating Time (hr.) | 16 | 5 | 14 | 10 | 4 | 2 | 10/60 | 5/60 | 1/8 |
| Thickness of the formed Layer or | 7 | 5 | 10 | 10 | 15 | 20 | 10 | 12 | 8 |

Table 11-continued

| Specimen No. | 13-1 | 13-2 | 13-3 | 13-4 | 13-5 | 13-6 | 13-7 | 13-8 | 13-9 |
|---|---|---|---|---|---|---|---|---|---|
| Layers ($\mu$) | | | | | | | | | |

After the treatment, Specimens 13-1 to 13-9 were examined in the same way as described in Example 1. All the treated Specimens 13-1 to 13-9 were formed respectively with the layers having a respective thickness shown in Table 11. Each of the layers formed on Specimens 13-1 to 13-4 was identified as consisting of a titanium carbide layer. Specimens 13-5 to 13-8 were formed respectively with the layers consisting of three layers, the uppermost layer composed of titanium boride ($TiB_2$), the middle layer composed of titanium carbide (TiC) and the lowest layer composed of cobalt boride ($Co_3B$). The thickness of the lowest layer, the cobalt boride layer has a tendency to increase according to the increase of the current density of the cathode. The layer formed on Specimen 13-9 was identified to be a cobalt boride ($Co_3B$) layer, from which a small amount of titanium was detected but titanium carbide was not detected.

Figure 11:
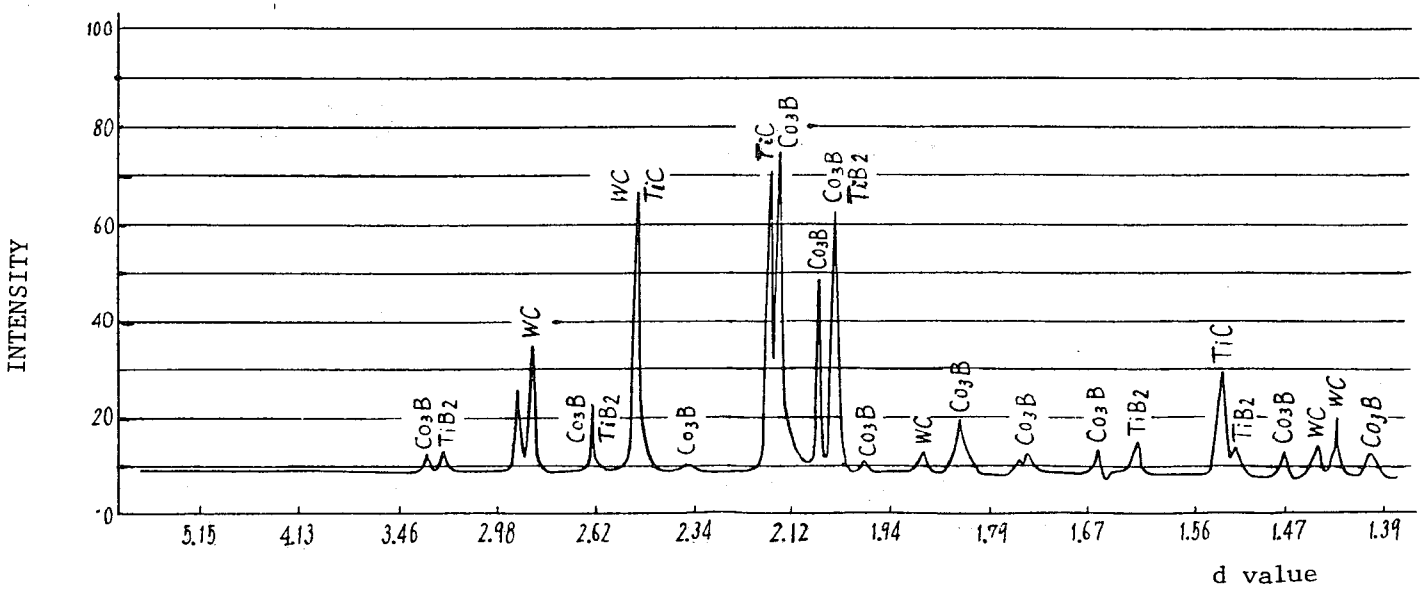
FIG. 11 is an X-ray diffraction chart of the layer formed on cemented carbide according to Example 13.

As one example of the results by X-ray diffraction, the X-ray diffraction chart taken from the layers formed on Specimen 13-6 is shown in FIG. 11.

Specimens treated under one of the same conditions as those of Specimens 13-13 and 13-17 were subjected to either the oxidation test or the corrosion test which were described in Example 11 for estimating the oxidation and corrosion resistances of the Specimens having a titanium carbide layer or the layers composed of a titanium boride layer and a titanium carbide layer which were formed according to this Example.

The weight gain (being used as an index of the oxidation resistance) and weight loss (being used as an index of the corrosion resistance) of the specimens treated under the same conditions as that of Specimen 13-3 were 15.33 mg/cm² and 6.85 mg/cm² respectively. The weight gain and weight loss of the specimens treated under the same condition as that of Specimen 13-7 were 5.10 mg/cm² and 5.16 mg/cm² respectively.

EXAMPLE 14

500 grams of borax was introduced into a graphite crucible having a 65 mm innerdiameter and heated up to 1000° C in an electric furnace under air to melt the borax. Then, 75 grams of $ZrO_2$ powder was introduced into the molten borax and mixed together. Thus, the molten bath was prepared.

Next, each of Specimens 14-1 to 14-6, 40 × 5.5 × 1.0mm and made of cemented carbide composed 91% of tungsten carbide and 9% cobalt was treated under the respective conditions shown in Table 12 in the same manner as described in Example 1.

Table 12

| Specimen No. | 14-1 | 14-2 | 14-3 | 14-4 | 14-5 | 14-6 |
|---|---|---|---|---|---|---|
| Current Density of Cathode (A/cm²) | 0.01 | 0.05 | 0.5 | 1.0 | 5.0 | 10 |
| Treating Time(hr.) | 16 | 12 | 13 | 3 | 1 | 10/60 |
| Thickness of the formed Layer or Layers ($\mu$) | 10 | 12 | 15 | 6 | 15 | 5 |

After the treatment, Specimens 14-1 to 14-6 were examined by the same way as described in Example 1. All the treated Specimens 14-1 and 14-6 were formed with the layers having the respective thickness shown in Table 12. Each of the layers formed on Specimens 14-1 to 14-4 was identified as consisting of two layers, the upper layer composed of zirconium boride ($ZrB_2$) and the lower layer composed of zirconium carbide (ZrC). The layers formed on Specimens 14-5 and 14-6 were identified as consisting of two layers, the upper layer composed of zirconium boride and the lower layer composed of tungsten boride ($W_2B_2$). Zirconium carbide was not detected in the layers.

EXAMPLE 15

90 grams of borax was introduced into a graphite crucible having a 35mm inner diameter and heated up to 1000° c in an electric furnace to melt the borax. Then, 25 grams of $ZrCl_4$ powder was introduced gradually into the molten borax and mixed together. Thus, the treating molten bath was prepared.

Next, each of Specimens 15-1 to 15-9, 40 × 5.5 × 1.0mm and made of cemented carbide composed of 91% of tungsten carbide and 9% of cobalt was treated under the respective conditions shown in Table 13 in the same manner as described in Example 1.

Table 13

| Specimen No. | 15-1 | 15-2 | 15-3 | 15-4 | 15-5 | 15-6 | 15-7 | 15-8 | 15-9 |
|---|---|---|---|---|---|---|---|---|---|
| Current Density of Cathode (Acm²) | 0.01 | 0.05 | 0.1 | 0.5 | 1.0 | 5.0 | 10 | 15 | 20 |
| Treating Time (hr.) | 16 | 15 | 16 | 6 | 3 | 1 | 5/60 | 3/60 | 1/60 |
| Thickness of the formed Layer or Layers($\mu$) | 13 | 20 | 23 | 18 | 13 | 10 | 5 | 9 | 10 |

After the treatment, Specimens 15-1 to 15-9 were examined in the same way as described in Example 1. All of the treated Specimens 15-1 to 15-9 were formed with the layers having a respective thickness shown in Table 13. Each of the layers formed on Specimen 15-1 to 15-4 was identified as consisting of two layers, the upper layer composed of zirconium boride ($ZrB_2$) and the lower layer composed of zirconium carbide (ZrC). The layers formed on Specimens 15-5 to 15-8 were identified as consisting two layers, the upper layer composed of zirconium boride ($ZrB_2$) and the lower layer composed of tungsten boride ($W_2B_5$). The layer formed on Specimen 15–9 was identified as being a tungsten boride layer. Specimen 15–9 was not formed with the desired layer such as zirconium boride or zirconium carbide layer.

What is claimed is:

1. A method for forming a hard layer comprising the carbide of titanium on the surface of an iron or ferrous alloy article containing at least 0.05% by weight of carbon, comprising the steps of preparing a molten bath consisting essentially of 60 to 99% by weight of a molten boron compound selected from the group consisting of boric acid and borate and 1 to 40% by weight of a substance containing titanium in a vessel, immersing the article into the molten bath at a temperature within the range of from 800° to 1100° C, applying an electric current with a current density of cathode within a range of 0.005 to 5 A/cm² to the molten bath through said article being used as the cathode and a carbon anode being contacted with the molten bath for forming the hard layer comprising the carbide of titanium on the surface of said article, and taking said article out of said molten bath.

2. A method according to claim 1, wherein said borate is selected from the group consisting of sodium borate, potassium borate and lithium borate.

3. A method according to claim 1, wherein said substance is a pure metal or an alloy of titanium.

4. A method according to claim 3, wherein said metal or alloy is in the form of powder or plate.

5. A method according to claim 3, wherein said metal or alloy is in a form of block and said block is anodically dissolved in the molten boric acid or borate.

6. A method according to claim 3, wherein said article is treated in said treating molten bath with a current density of the cathode within a range from 0.005 to 1.5 A/cm².

7. A method according to claim 1, wherein said substance is a compound of titanium.

8. A method according to claim 7, wherein said compound of titanium is selected from the group consisting of $TiO_2$, $K_2TiO_3$, $Na_2TiO_3$, $Li_2TiO_3$ and the mixture thereof.

9. A method according to claim 7, wherein said article is treated in said treating molten bath with a current density of the cathode within a range from 0.01 A/cm² to 3 A/cm².

10. A method according to claim 1, wherein said substance is a halide of titanium.

11. A method according to claim 10, wherein said halide is selected from the group consisting of $TiCl_3$, $TiF_6$, $TiI_4$, $Na_2TiF_6$, $(NH_4)_2TiF_6$ and the mixture thereof.

12. A method according to claim 10, wherein said article is treated in said treating molten bath with a current density of the cathode within a range from 0.01 A/cm² to 5 A/cm².

* * * * *